United States Patent [19]

Monser

[11] Patent Number: 4,814,777

[45] Date of Patent: Mar. 21, 1989

[54] DUAL-POLARIZATION, OMNI-DIRECTIONAL ANTENNA SYSTEM

[75] Inventor: George J. Monser, Goleta, Calif.

[73] Assignee: Raytheon Company, Lexington, Mass.

[21] Appl. No.: 80,264

[22] Filed: Jul. 31, 1987

[51] Int. Cl.[4] ..... H01Q 21/00

[52] U.S. Cl. ..... 343/727; 343/799; 343/829; 343/826

[58] Field of Search ..... 343/727, 725, 797, 798, 343/799, 800, 826, 829, 853, 846, 893; 342/372, 373

[56] References Cited

U.S. PATENT DOCUMENTS

| | | | |
|---|---|---|---|
| 2,581,352 | 1/1952 | Bliss | 343/797 |
| 3,413,644 | 11/1968 | Laub et al. | 343/800 |
| 3,594,808 | 7/1971 | Koob | 343/799 |
| 3,805,266 | 4/1974 | Fletcher et al. | 343/853 |
| 4,700,197 | 10/1987 | Milne | 343/846 |

FOREIGN PATENT DOCUMENTS

| | | | |
|---|---|---|---|
| 2502376 | 7/1976 | Fed. Rep. of Germany | 343/727 |

*Primary Examiner*—William L. Sikes
*Assistant Examiner*—Hoanganh Le
*Attorney, Agent, or Firm*—Edmund J. Walsh; Richard M. Sharkansky

[57] ABSTRACT

An antenna system comprising a vertical monopole antenna coupled to a first feed on a ground plane conductor and a dipole antenna comprising a plurality of horizontal dipole antenna elements coupled to a corresponding plurality of feeds on the ground plane conductor, the plurality of dipole antenna elements being disposed about the first feed. The vertical monopole antenna comprises a plurality of monopole antenna elements, the plurality of monopole antenna elements and the plurality of dipole antenna elements being alternately radially disposed about the first feed. With such arrangement, the plurality of vertical monopole elements produce a vertically polarized beam having a predetermined (such as omni-directional) radiation pattern about the first feed, and the plurality of horizontal dipole antenna elements produce a horizontally polarized beam having a predetermined (such as omni-directional) beam pattern about the first feed; that is, the antennas are provided with substantially coincident phase centers. The monopole antenna elements do not substantially adversely affect (i.e. shadow) the omni-directional beam pattern produced by dipole antenna elements, and the dipole antenna elements do not substantially adversely affect the omni-directional beam pattern produced by the monopole antenna elements. Thus, the vertically polarized antenna elements may be disposed in close proximity to the horizontally polarized antenna elements, with no substantial degradation of the omni-directional beam patterns of either antenna, thereby allowing the total size of the antenna system to be reduced.

28 Claims, 5 Drawing Sheets

DUAL-POLARIZATION, OMNI-DIRECTIONAL ANTENNA SYSTEM

BACKGROUND OF THE INVENTION

The present invention relates generally to radio frequency (RF) antenna systems and more particularly to omni-directional RF antenna systems responsive to energy having two polarization senses.

As is known, antenna systems for transmitting or receiving RF energy in omni-directional (i.e. 360°) beam patterns have a wide variety of applications, such as in electronic countermeasures (ECM) systems. Often, it is required that such an antenna system be responsive to both energy having vertical polarization and horizontally polarized energy. One conventional antenna system comprises a vertical monopole antenna disposed to one side of a pair of crossed dipole antennas, comprising four orthogonally disposed antenna elements, the monopole and dipole antennas being supported above a ground plane conductor. Typically, a transmitter (or receiver) is coupled to an RF switch, with a first switch contact being coupled to the monopole antenna and a second switch contact being coupled through a phase shifting network to the dipole antenna elements, with each pair of dipole antenna elements being fed 180° out-of-phase and in quadrature with respect to one another. The monopole antenna of such conventional antenna assembly radiates (or receives) a vertically polarized (with respect to the ground plane) beam of energy having a nominal radiation pattern which is substantially omni-directional about the monopole antenna over a relatively wide operating frequency bandwidth. The dipole antenna radiates (or receives) a horizontally polarized beam of energy with a nominal radiation pattern which is substantially omni-directional about the dipole antenna, typically over a more narrow frequency bandwidth. To extend the bandwidth of the dipole antenna, a second crossed dipole antenna having the desired operating bandwidth typically is coupled to the transmitter (or receiver) and disposed over the ground plane conductor adjacent to the monopole antenna and first dipole antenna, generally with the dipole antennas and monopole antenna being disposed side by side over the ground plane.

While the above-described dual-polarization, omni-directional antenna system has functioned satisfactorily in some applications where the adjacently disposed monopole and dipole antennas are widely spaced from each other, in other applications (such as airborne applications) requiring such antennas to be disposed closely together, the omni-directionality of the beam patterns produced thereby are severely degraded. That is, with such monopole antenna and dipole antenna or antennas disposed in close proximity with each other, the monopole antenna produces blocking or "shadowing" of the beam pattern of each of the dipole antennas in directions corresponding to the locations of the monopole antenna with respect to the dipole antennas. Likewise, the dipole antennas block or shadow the beam pattern of the monopole antenna in directions corresponding to the location of the dipole antennas with respect to the monopole antenna. The gain of each antenna is reduced (that is, signal "drop-out" is experienced) in the direction of such shadowing, resulting in a concomitant decrease in the omni-directionality of each beam pattern.

Such beam pattern degradation, if sufficiently severe, produces "holes" in the coverage of the antenna system.

Accordingly, it is an object of the present invention to provide an omni-directional, dual-polarization antenna system wherein the antenna for vertically polarized energy is disposed in close proximity with the antenna for energy having horizontal polarization, with neither one of such antennas substantially adversely affecting the omni-directionality of the other one of such antennas.

It is a further object of the present invention to provide an omni-directional, dual-polarization antenna system operative over a relatively wide frequency bandwidth, such as a bandwidth of greater than one octave.

SUMMARY OF THE INVENTION

In accordance with the present invention, an omni-directional, dual-polarization antenna system is provided comprising a first antenna responsive to energy having a first polarization and a second antenna responsive to energy having a second polarization, orthogonal to the first polarization, said second antenna comprising a plurality of antenna elements disposed about said first antenna. With such arrangement, a dual-polarization antenna system is provided having reduced size, with the radiation pattern of each one of the first and second antennas being substantially non-adversely affected by the presence of the other one of the first and second antennas. Thus, such antenna system is operative over a relatively large bandwidth, such as greater than one octave, with minimal "shadowing" effects between the first and second antennas.

In a preferred embodiment of the present invention, the first antenna comprises a vertical monopole antenna coupled to a first feed on a ground plane conductor, with the second antenna comprising a plurality of horizontal dipole antenna elements coupled to a corresponding plurality of feeds on the ground plane conductor, the plurality of dipole antenna elements being disposed about the vertical monopole antenna. The vertical monopole antenna comprises a plurality of monopole antenna elements coupled to the first feed, the plurality of monopole antenna elements and the plurality of dipole antenna elements being alternately radially disposed about the first feed. With such arrangement, the plurality of vertical monopole elements produce a vertically polarized beam having a predetermined (such as omni-directional) radiation pattern about the first feed, and the plurality of horizontal dipole antenna elements produce a horizontally polarized beam having a predetermined (such as omni-directional) beam pattern about the first feed; that is, the antennas are provided with substantially coincident phase centers. It has been found that the monopole antenna elements do not substantially adversely affect (i.e. shadow) the omni-directional beam pattern produced by dipole antenna elements, and the dipole antenna elements do not substantially adversely affect the omni-directional beam pattern produced by the monopole antenna elements. Thus, the vertically polarized antenna elements may be disposed in close proximity to the horizontally polarized antenna elements, with no substantial degradation of the omni-directional beam patterns of either antenna, thereby allowing the total size of the antenna system to be reduced. In fact, the integration of the monopole antenna within the dipole antenna elements provides additional space and volume in the antenna assembly for optimization of design parameters (such as the dimensions of the monopole and dipole antenna elements), thereby allowing the bandwidth of the antenna assembly to be increased. Also, the plurality of monopole antenna elements may provide reflection of the beam produced by the dipole antenna elements to reduce the elevation beamwidth of such beam and thereby increase the gain of the dipole antenna elements. Moreover, the reduction in shadowing introduced by the dipole antenna and the monopole antenna provide fewer dropouts in the 360° (i.e. omni-directional) beam patterns radiated by such antennas, thereby increasing the average gain of such antennas over such 360° field.

BRIEF DESCRIPTION OF THE DRAWINGS

The foregoing features of the present invention and the advantages thereof may be fully understood with reference to the following detailed description read in conjunction with the appended drawings wherein.

DESCRIPTION OF THE PREFERRED EMBODIMENTS

Figure 1:
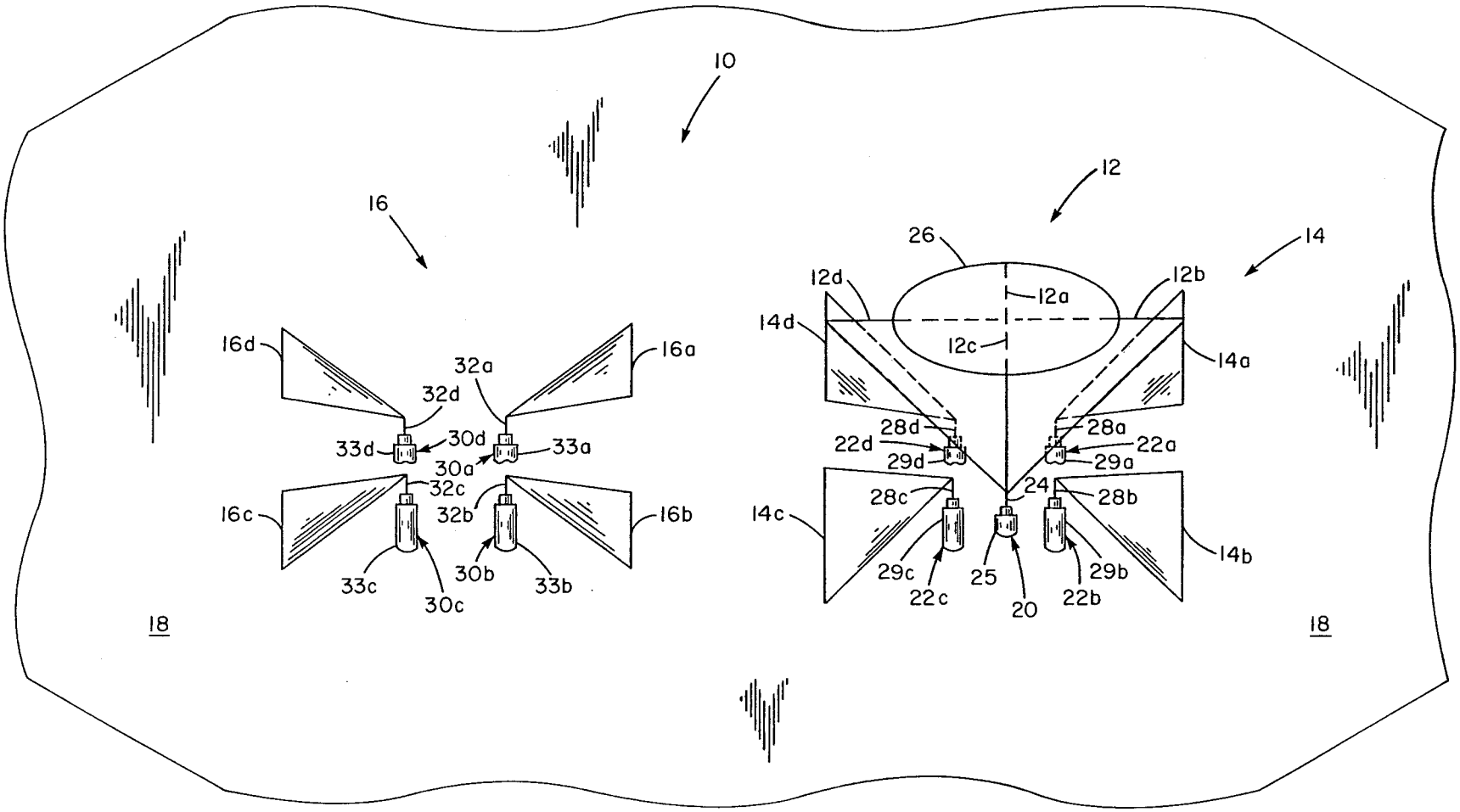
FIG. 1 is an isometric view of a preferred embodiment of the dual polarization antenna system of the present invention.
Figure 2:
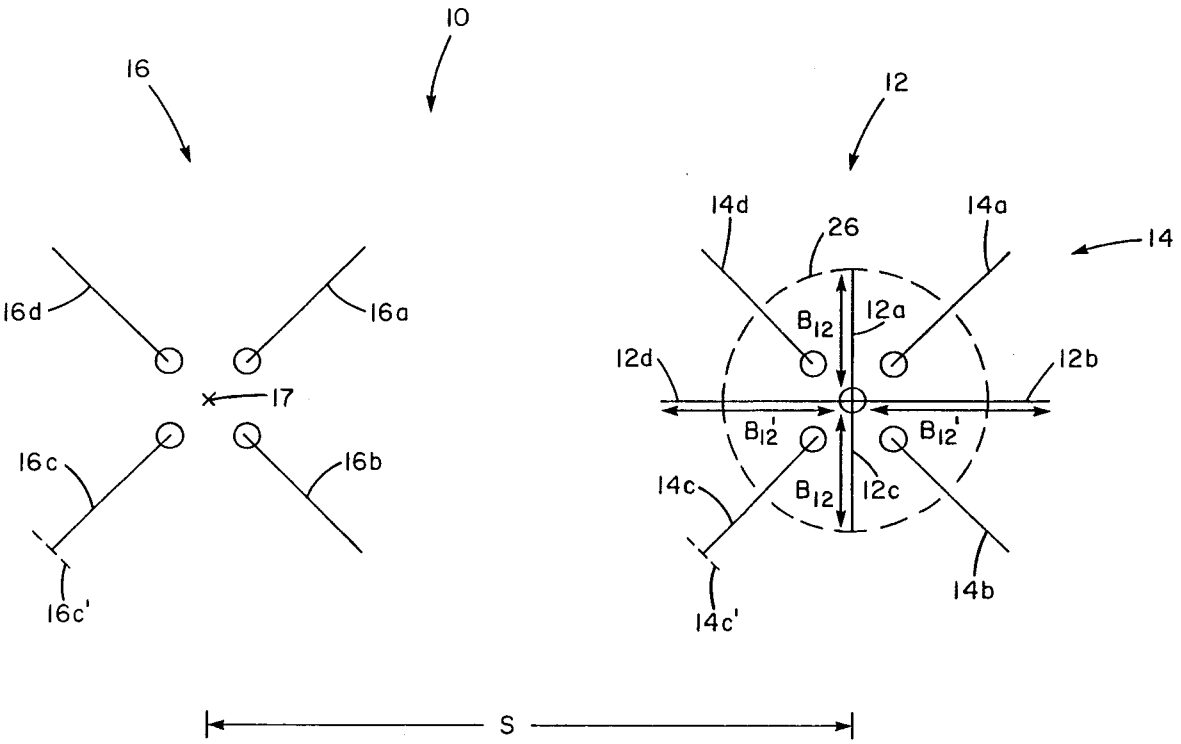
FIG. 2 is a top plan view of the antenna system of FIG. 1.
Figure 3:
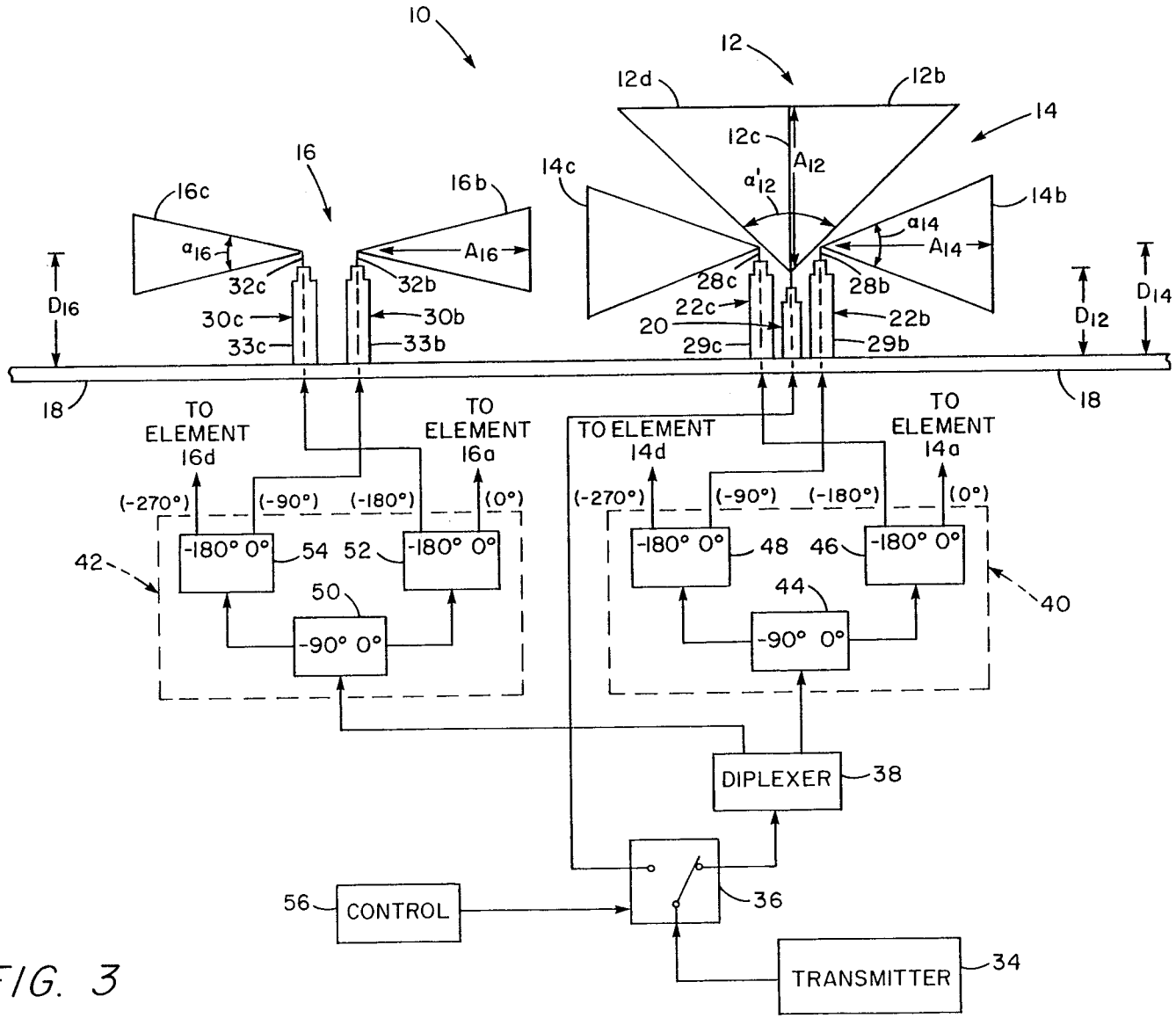
FIG. 3 is a block diagram and side plan view taken from a different perspective of the antenna system of FIG. 1.

Referring to FIGS. 1–3, antenna system 10 is shown comprising first antenna 12 responsive to radio frequency (RF) energy having a first (here vertical) polarization and a second antenna 14 responsive to RF energy having a second (here horizontal) polarization orthogonal to the first polarization. Antenna system 10 here also comprises a third antenna 16 responsive to horizontally polarized RF energy for purposes to be discussed. The arrangement of antennas 12, 14, 16 with respect to each other is discussed in detail hereinafter. Suffice it here to say that first antenna 12 is disposed within a plurality of antenna elements of one of antennas 14, 16—here antenna elements **14*a*–14*d* of second antenna 14. That is, such elements 14*a*–14*d* are disposed about first antenna 12 to provide antennas 12, 14 with substantially coincident phase centers. With such arrangement, antenna 12 produces a vertically polarized beam of RF energy having a predetermined, nominal radiation pattern, here substantially an omni-directional pattern about antenna 12. Antenna 14 forms a horizontally polarized beam of RF energy having a predetermined, nominal radiation pattern, here substantially an omni-directional pattern about antenna 14 and antenna 12. The arrangement of antenna elements 14*a*–14*d* about antenna 12 is found to not substantially adversely affect the nominal omni-directional beam pattern produced by antenna 12. Likewise, the arrangement of antenna 12 within antenna elements 14*a*–14*d* does not substantially degrade the nominal omni-directional beam pattern produced by antenna 14. Thus, a dual-polarization, omni-directional antenna system 10 is provided having reduced size with substantially no degradation of the nominal omni-directional vertically and horizontally polarized radiation patterns formed by antenna 12, 14**, respectively.

Antenna 12 is here a monopole antenna comprising a plurality, here four, of antenna elements **12*a*–12*d* supported above a ground plane conductor 18 (here a sheet of copper) by RF feed 20. Here, RF feed 20 is coaxial and comprises center conductor 24 coupled to antenna elements 12*a*–12*d* and a conductive shield 25 dielectrically spaced from center conductor 24 and electrically coupled to ground plane 18, such as by soldering. As shown in FIG. 3, monopole antenna elements 12*a*–12*d* here each comprise a generally right-triangular shaped blade (here comprising copper). The apexes of elements 12*a*–12*d* are secured to center conductor 24, with feed 20 supporting elements 12*a*–12*d* vertically above ground plane 18. As shown in FIG. 2, here monopole antenna elements 12*a*–12*d* are radially disposed orthogonally to each other about feed 20. Monopole antenna 12 here additionally comprises a generally circular-shaped member 26 disposed atop monopole elements 12*a*–12*d* in parallel with ground plane 18**, for purposes to be described.

Antenna 14 is here a dipole antenna comprising, as discussed, a plurality (here four) of antenna elements **14*a*–14*d*. Antenna elements 14*a*–14*d* are horizontally disposed above ground plane 18 and supported by feeds 22*a*–22*d*, respectively, as shown in FIG. 1. Feeds 22*a*–22*d* here are each coaxial feeds comprising center conductors 28*a*–28*d*, secured to respective dipole antenna elements 14*a*–14*d*, and shield conductors 29*a*–29*d*, respectively, electrically coupled to ground plane 18. It is noted that feeds 22*a*, 22*d* are shown partially cut away in FIG. 1 for the sake of clarity. Here, dipole antenna elements 14*a*–14*d* each comprise a generally isosceles-triangular shaped blade comprising copper. Dipole antenna elements 14*a*–14*d* are orthogonally disposed with respect to one another and arranged about monopole antenna 12, specifically about feed 20, as shown. Monopole antenna elements 12*a*–12*d* thus are alternately radially disposed about feed 20 with dipole antenna elements 14*a*–14*d*. Thus, it is seen that antennas 12, 14 are disposed about substantially the same point—feed 20—rather than being disposed side-by-side on ground plane 18. Each monopole antenna element 12*a*–12*d* here substantially bisects the 90° angle between a pair of dipole antenna elements 14*a*–14*d*, and each dipole antenna element 14*a*–14*d* here substantially bisects the 90° angle between a pair of monopole antenna elements, as shown in FIG. 2**.

Second antenna 16 here is a dipole antenna comprising a plurality, here four, of dipole antenna elements **16*a*–16*d* disposed adjacent to antennas 12, 14 above ground plane 18, as shown in FIG. 1. Dipole antenna elements 16*a*–16*d* here each comprise a generally isosceles-triangular shaped blade (here comprising copper) horizontally supported above ground plane 18 by RF feeds 30*a*–30*d*, respectively. Here, dipole antenna elements 16*a*–16*d* are arranged orthogonally to one another above ground plane 18 about a point 17 (FIG. 2) on such ground plane 18, with corresponding antenna elements 16*a*–16*d*, 14*a*–14*d* of dipole antennas 16, 14 here being parallel to each other, as shown in FIG. 2. Feeds 30*a*–30*d* here are coaxial feeds comprising respective center conductors 32*a*–32*d* coupled to corresponding antenna elements 16*a*–16*d***, with such feeds 30a–30d further comprising shield conductors 33a–33d, respectively, dielectrically spaced from corresponding center conductors 32a–32d and coupled to ground plane 18, such as by soldering.

Here, antenna system 10 is selected to operate over a wide frequency band, $f_L$ to $f_H$, such as greater than one octave, about a midband frequency $f_o$. The dimensions of antenna elements 12a–12d, 14a–14d, 16a–16d and the location thereof relative to ground plane 18 are selected to provide such operating frequency range. Referring to FIG. 3, monopole antenna elements 12a–12d have altitude and base dimensions selected in accordance with the wavelength, $\lambda_o$, of midband frequency $f_o$. Monopole antenna 12 is a wideband device capable of operating over the greater than one octave frequency band ($f_L$ to $f_H$). Here, the base dimensions of antenna elements 12b, 12d are selected to differ slightly from those of antenna elements 12a, 12c for purposes to be discussed. As shown in FIG. 3, monopole antenna elements 12b, 12d have an altitude dimension, $A_{12}$, (disposed vertically with respect to ground plane 18) here selected to be approximately 1/5 $\lambda_o$. Here, monopole antenna elements 12a, 12c also have an altitude dimension of substantially 1/5 $\lambda_o$. Referring also to FIG. 2, the base dimension, $B_{12}$, of monopole antenna elements 12a, 12c is here selected to be approximately $\frac{1}{8}\lambda_o$, while the base dimension, $B_{12}'$, of each of monopole antenna elements 12b, 12d is here slightly longer, approximately 1/6 $\lambda_o$. To put it another way, monopole antenna elements 12b, 12d subtend a flare angle, $\alpha_{12}'$ (FIG. 3), here selected to be substantially 90°, while the flare angle (not shown) defined by monopole antenna elements 12a, 12c is here somewhat less, approximately 60°. It has been found that providing such dimensional differences between monopole antenna elements 12a, 12c and 12b, 12d improves the impedance match (and hence decreases the VSWR) of monopole antenna 12 with RF feed 20 over the operating band (i.e. $f_L$ to $f_H$). Member 26, here having a generally circular shape with a radius of approximately $\frac{1}{8}\lambda_o$ (i.e. approximately equal to the base dimension, $B_{12}$, of elements 12a, 12c), is disposed atop monopole antenna elements 12a–12d, as shown in FIG. 1. Such member 26 extends the operating bandwidth of monopole antenna 12 by augmenting the electrical lengths of elements 12a–12d and thus permitting monopole antenna 12 to operate at a lower frequency (i.e. down to $f_L$). Here, feed 20 supports monopole antenna elements 12a–12d a distance $D_{12}$) (FIG. 3) above ground plane 18, such distance $D_{12}$ preferably being selected to be as small as possible to further improve the impedance match between RF feed 20 and monopole antenna 12. Here, $D_{12}$ is substantially less than 1/10 $\lambda_o$.

Dipole antenna 14 is not as wideband as monopole antenna 12. Thus, here a pair of dipole antennas 14, 16 are provided operable over different portions of the total operating bandwidth ($f_L$ to $f_H$). Here, dipole antenna 14 operates over the low end of such frequency range, such as from $f_L$ to substantially midband frequency $f_o$, and thus each antenna element 14a–14d has dimensions selected accordingly. Dipole antenna 16 here operates over the high end of the total frequency band, such as from substantially $f_o$ to $f_H$, and thus each antenna element 16a–16d has dimensions selected accordingly. Referring to FIG. 3, dipole antenna elements 14a–14d here each have an altitude dimension ($A_{14}$), disposed horizontally with respect to ground plane 18, of substantially 1/7 $\lambda_o$. The corresponding altitude dimension ($A_{16}$) of higher-operating frequency dipole antenna elements 16a–16d is here substantially the same as $A_{14}$. It is noted that the electrical lengths of dipole antenna elements 14a–14d, 16a–16d may be increased by disposing "caps" (such as members 14c', 16c', shown in phantom in FIG. 2) perpendicularly on the ends of elements 14a–14d, 16a–16d, thereby increasing the respective electrical lengths of antennas 14, 16. Here, dipole antenna elements 14a–14d have a predetermined flare angle, $\alpha_{14}$, of, here 60°. The flare angle, $\alpha_{16}$, of higher-operating-frequency dipole antenna elements 16a–16d is here 30°. Feeds 22a–22d, 30a–30d support dipole antenna elements 14a–14d, 16a–16d a predetermined distance above ground plane 18. Dipole antenna elements 14a–14d, 16a–16d are disposed at respective distances $D_{14}$ and $D_{16}$ above ground plane 18. Here, such distances $D_{14}$, $D_{16}$ are substantially equal and are selected to be approximately 1/6 $\lambda_o$. Dipole antennas 14, 16 are here spaced from each other by a predetermined distance S, here approximately $\frac{1}{3}\lambda_o$, as shown in FIG. 2, to minimize shadowing and coupling between such dipole antennas 14, 16.

Referring to FIG. 3, the electrical connections of antennas 12, 14, 16 to a transmitter 34 are schematically shown. It is noted that antenna system 10 is also operable with a receiver substituted for transmitter 34 due to the principles of reciprocity. The output of transmitter 34 is coupled to RF switch 36, with one switched terminal thereof being coupled directly to monopole antenna 12 and the other switched terminal thereof being applied to diplexer 38. Such diplexer 38 couples signals having frequencies substantially between $f_L$ and $f_o$ to dipole antenna 14 via phase shifting arrangement 40, and signals having frequencies substantially between $f_o$ and $f_H$ to dipole antenna 16 via phase shifting arrangement 42. Alternately, diplexer 38 may be implemented as a switch responsive to, for example, a control signal from transmitter 34 for switchably coupling the RF signal to either antenna 14 or antenna 16 depending on the frequency thereof. Each phase shifting arrangement 40, 42 produces four quadrature signals having relative phases of 0°, −90°, −180°, −270°, respectively, which are coupled to dipole antennas 14, 16. Specifically, phase shifting arrangement 40 comprises 90° hybrid coupler 44 having 0° and −90° outputs coupled as shown to a pair of 180° couplers (also known as "magic tees") 46, 48, respectively. The 0° output of coupler 46 (0° relative phase) is coupled to antenna element 14a, with the 0° output of coupler 48 (−90° relative phase) being applied to antenna element 14b. Likewise, the −180° outputs of couplers 46, 48 (−180°, −270° relative phases, respectively) are coupled to antenna elements 14c, 14d, respectively. Phase shifting arrangement 42 likewise comprises 90° hybrid coupler 50 having 0° and −90° outputs applied to a pair of 180° couplers 52, 54, respectively. The 0° output of coupler 52 (0° relative phase) is coupled to dipole antenna element 16a, with the 0° output of coupler 54 (−90° relative phase) being applied to antenna element 16b. Similarly, the −180° outputs of couplers 52, 54 (−180°, −270° relative phases, respectively) are coupled to antenna elements 16c, 16d, respectively.

In operation, antenna system 10 here either transmits a vertically polarized beam or a horizontally polarized beam, as selected by controller 56. If vertical polarization is selected, controller 56 applies a control signal to RF switch 36 for coupling the output of transmitter 34 through switch 36 to monopole antenna 12. Such monopole antenna 12, being vertically supported above ground plane 18, radiates a vertically polarized beam of energy in a nominally omni-directional pattern about antenna 12 and feed 20. Conversely, if a horizontally polarized beam is to be produced, controller 56 changes the switched position of RF switch 36 to thereby couple the output of transmitter 34 to dipole antennas 14, 16 via diplexer 38 and phase shifting arrangements 40, 42. Dipole antenna 14, in response to quadrature (0°, −90°, −180°, −270°) signals being coupled to horizontally disposed antenna elements **14*a*–14*d*, respectively, thereof, radiates a horizontally polarized beam of energy, having a nominal omni-directional beam pattern about antennas 12, 14 and feed 20, substantially over the portion $f_L$ to $f_o$ of the frequency band. Dipole antenna 16 responds to the quadrature signals applied to horizontally disposed antenna elements 16*a*–16*d* thereof over substantially the $f_o$ to $f_H$ portion of the frequency band by radiating a horizontally polarized beam, such beam being nominally omni-directional about point 17 (FIG. 2) about which antenna elements 16*a*–16*d*** are disposed.

Figure 4:
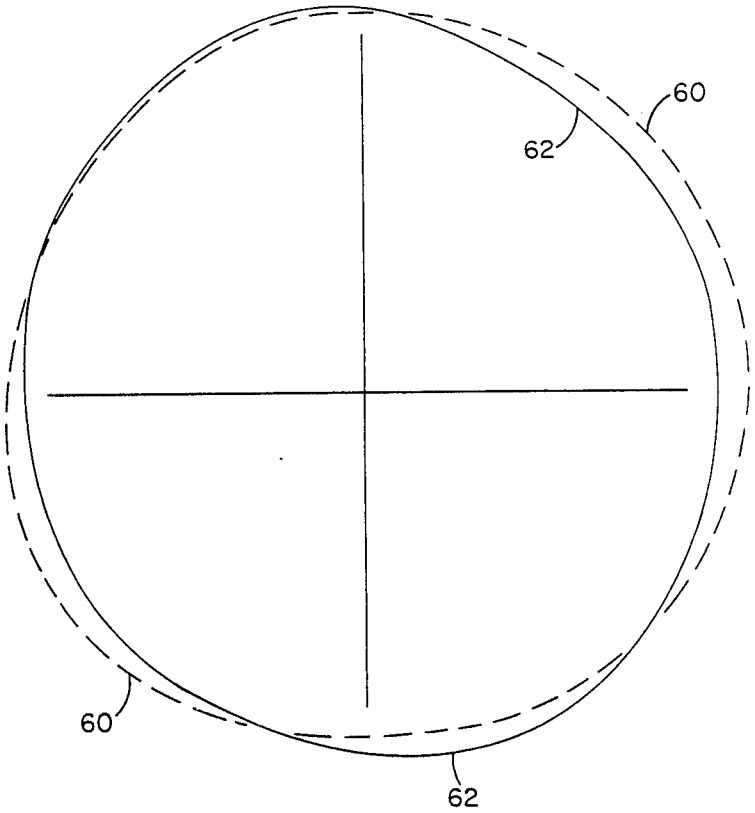
FIG. 4 illustrates radiation patterns of one of the antennas of the antenna system of FIG. 1 useful in understanding the invention.

As discussed in the Background of the Invention section, in conventional omni-directional, dual-polarization systems wherein the vertically polarized (i.e. monopole) antenna is disposed side-by-side with of the horizontally polarized (i.e. dipole) antennas, with such antennas thus having noncoincident phase centers, the monopole antenna produces a blocking or shadowing affect on the beams radiated by the dipole antennas (thereby degrading the omni-directionality thereof) and likewise the dipole antennas provide unwanted shadowing of the beam produced by the monopole antenna (thus adversely affecting the omni-directionality of such beam). This problem is substantially reduced in the present invention by the arrangement of one of the dipole antennas (here antenna 14) about monopole antenna 12, that is, the arrangement of dipole antenna elements **14*a*–14*d* about monopole antenna feed 20, to provide such antennas 12, 14 with substantially coincident phase centers about feed 20. It is also noted that with such arrangement, the overall size of antenna system 10 is reduced, since monopole antenna 12 is enclosed within the feeds 22*a*–22*d* of dipole antenna elements 14*a*–14*d* rather than being disposed to one side of dipole antenna 14. It has been found that monopole antenna elements 12*a*–12*d*, rather than producing the aforementioned "shadowing" effect on the nominally omni-directional, horizontally polarized beam radiated by crossed dipole antenna elements 14*a*–14*d*, act as reflectors for such beam to reduce the elevation beamwidth of such horizontally polarized beam above ground plane 18. Such reduction in elevation beamwidth produces a concomitant increase in the gain of dipole antenna 14. Further, the radiation pattern of the beam produced by dipole antenna 14 is found to be maintained at substantially the nominal omni-directional pattern which would be produced by dipole antenna 14 without the presence of monopole antenna 12. For example, referring to FIG. 4 shown is a beam pattern 60 having a nominal omni-directionality radiated by dipole antenna 14 at midband ($f_o$) with monopole antenna 12 (and dipole antenna 16) removed from antenna system 10. By contrast, beam pattern 62 radiated by dipole antenna 14 with monopole antenna 12 present (and disposed as described above and shown in FIGS. 1–3) is also depicted in FIG. 4. Comparison of beam patterns 60, 62 reveals that the omni-directionality of the beam radiated by dipole antenna 14 is only minimally affected by the presence of monopole antenna 12**.

Figure 5:
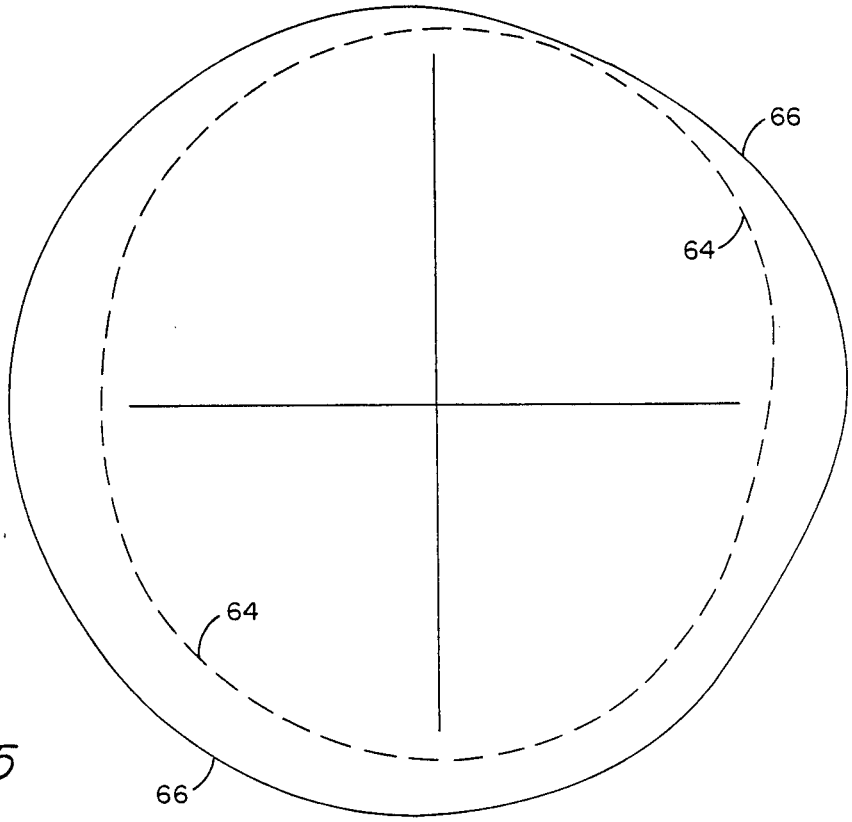
FIG. 5 illustrates radiation patterns of one of the antennas of the antenna system of FIG. 1 useful in understanding the invention.

Additionally, the radiation pattern of the vertically polarized beam radiated by monopole antenna 12 is found to not be substantially degraded from the nominal omnidirectional pattern by the presence of dipole antenna 14. For example, FIG. 5 shows a beam pattern 64 having a nominal omni-directionality produced by monopole antenna 12 at midband ($f_o$) with dipole antenna 14 (and dipole antenna 16) removed. The radiation pattern 66 of such beam with dipole antenna 14 arranged as described above and shown in FIGS. 1–3 is also depicted in FIG. 5. Comparison of beam patterns 64, 66 reveals no significant degradation of the omnidirectional beam radiated by monopole antenna 12 with dipole antenna 14 in place. Further, the improved impedance match between feed 20 and monopole antenna elements **12*a*–12*d*, provided, as discussed above, by the differing dimensions of monopole antenna elements 12*a*, 12*c* and 12*b*, 12*d* and the small distance ($D_{12}$) at which monopole antenna 12 is disposed above ground plane 18, reduces the VSWR of antenna 12 and concomitantly increases the gain of monopole antenna 12. Also, the total operating bandwidth of monopole antenna 12 is substantially increased, here to greater than two octaves. With the aforementioned bandwidth increase of dipole antenna 14, it is thus seen that the total operating band-width of antenna system 10** is increased to greater than two octaves.

It is noted that some blocking or shadowing is produced by dipole antenna 16 on the beams produced by antennas 12, 14 in the direction of such antenna 16 since dipole antenna 16 is adjacently disposed relatively closely (i.e. about $\frac{1}{3}\lambda_o$) to such antennas 12, 14. Likewise, antennas 12, 14 produce some blockage of the beam radiated by dipole antenna 16 in the direction of such antennas 12, 14. However, such shadowing effect due to the presence of dipole antenna 16 is found to be less than that which would occur if monopole antenna 12 were disposed side-by-side with dipole antennas 14, 16 rather than within the arrangement of dipole antenna elements **14*a*–14*d*, as provided in the present invention. Further, such shadowing effects may be eliminated by removing dipole antenna 16, which of course would reduce the bandwidth of horizontally polarized beams produced by antenna system 10 (here, $f_L$ to substantially $f_o$—the bandwidth of dipole antenna 14**).

Figure 6:
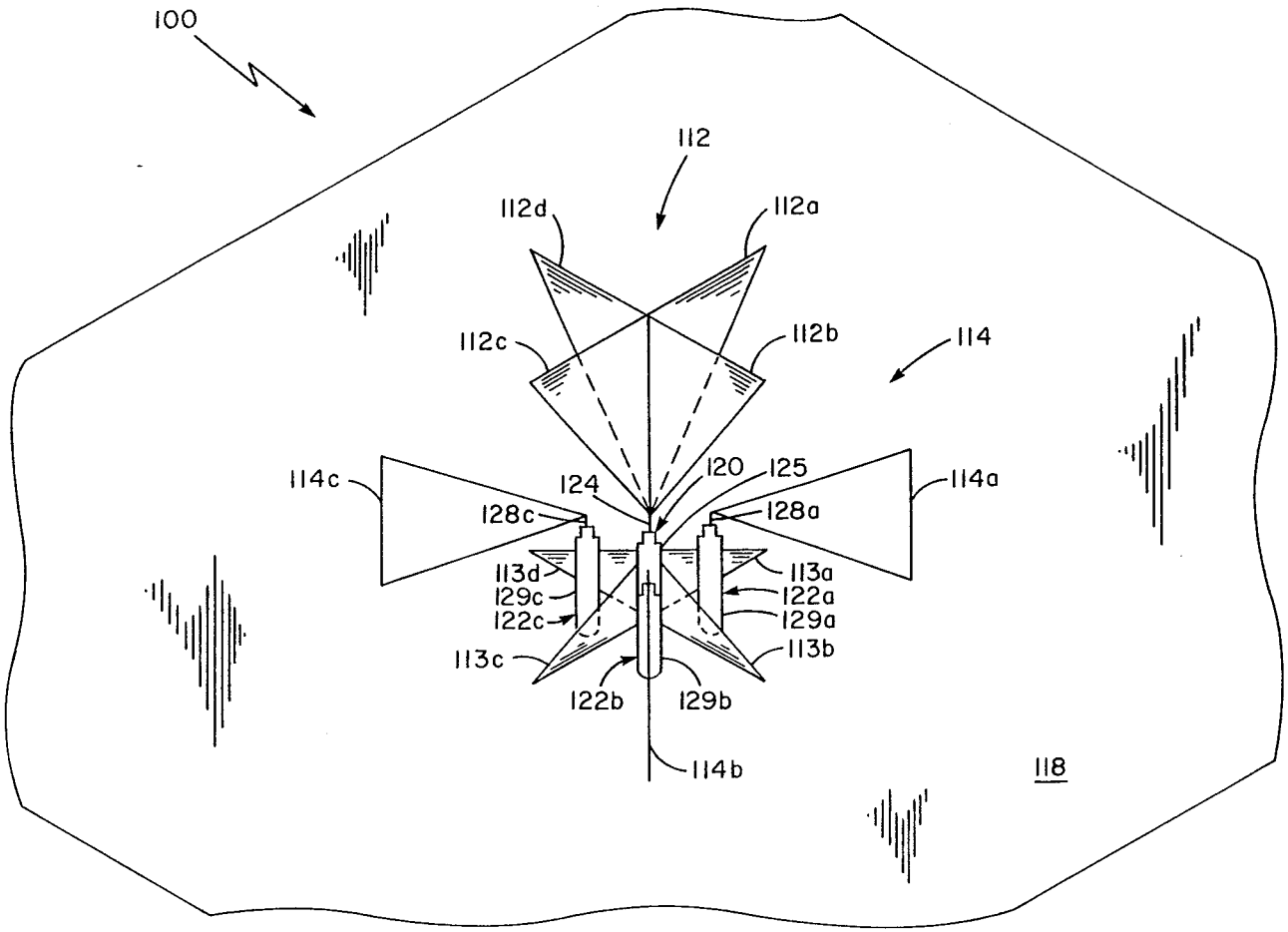
FIG. 6 is an isometric view of a second embodiment of the dual polarization antenna system of the present invention.

Referring now to FIG. 6, antenna system 100 according to a second embodiment of the present invention is shown comprising monopole antenna 112 and dipole antenna 114 disposed on ground plane conductor 118. Monopole antenna 112 comprises a plurality, here four, of monopole antenna elements **112*a*–112*d* orthogonally disposed with respect to one another and vertically supported above ground plane 118 by coaxial RF feed 120. Center conductor 124 of feed 120 is secured to antenna elements 112*a*–112*d*, as shown, with feed 120 shield conductor 125 being coupled to ground plane conductor 118, such as by soldering. Antenna elements 112*a*–112*d*, here comprising copper, are here generally right-triangularly shaped blades having dimensions selected in the manner discussed above for monopole antenna elements 12*a*–12*d* (FIG. 3). Monopole antenna 112 also comprises a member (not shown) disposed atop antenna elements 112*a*–112*d* horizontally with respect to ground plane 118 in the manner described above regarding member 26 (FIG. 1**).

Monopole antenna 112 additionally comprises a plurality, here four, of ground plane elements **113*a*–113*d* secured to feed shield 125 and ground plane 118**.

Ground plane elements 113a–113d are disposed below and in substantial alignment with corresponding monopole antenna elements 112a–112d, as shown. Thus, ground plane elements 113a–113d are orthogonally arranged about feed 20. Ground plane elements 113a–113d comprise copper blades, here having a generally right-triangular geometry, with the base dimension thereof here being substantially the same as that of monopole antenna elements 112a–112d (i.e. $B_m$—FIG. 3).

Dipole antenna 114 here is substantially identical to dipole antenna 14 (FIG. 1) and thus comprises four dipole antenna elements 114a–114d (element 114d not being shown in FIG. 6) orthogonally disposed with respect to each other about monopole antenna 112 (i.e. about RF feed 120) horizontally above ground plane 118. Dipole antenna elements 114a–114d are thus radially disposed about feed 20 alternately with monopole antenna elements 112a–112d and ground plane elements 113a–113d. Here, such dipole antenna elements 114a–114d bisect the 90° angle between a pair of monopole antenna elements 112a–112d (and hence between a pair of ground plane elements 113a–113d). Each dipole antenna element 114a–114d here comprises a copper, triangular shaped blade having dimensions selected in the manner discussed above regarding dipole antenna elements 14a–14d (FIG. 3). Dipole antenna elements 114a–114d are supported above ground plane 118 by coaxial RF feeds 122a–122d, respectively (feed 122d not being shown), with center conductors 128a–128d of such feeds 122a–122d (conductor 128d not being shown) being secured to respective dipole antenna elements 114a–114d. Shield conductors 129a–129d (shield 129d not being shown) are secured to ground plane 118, such as by soldering.

It is noted here that antenna system 100 may additionally comprise a second dipole antenna (not shown) disposed adjacent to antennas 112, 114 on ground plane 118 similarly as dipole antenna 16 (FIG. 1) is disposed adjacent to antennas 12, 14 to extend the bandwidth of the horizontally polarized beams radiated (or received) by antenna system 100, as discussed above. Monopole antenna 112 and dipole antenna 114 are here coupled to a transmitter (see FIG. 3) via a circuit arrangement similar to that shown in FIG. 3.

In operation, ground plane elements 113a–113d provide an elevated ground plane for corresponding monopole antenna elements 112a–112d. That is, the vertically polarized energy radiated by monopole antenna 112 is "launched" from antenna elements 112a–112d by radiating between the spacings between antenna elements 112a–112d and corresponding underlying ground plane elements 113a–113d. Such spacing is relatively small (here, less than approximately $\frac{1}{8}\lambda_o$) near antenna feed 120 and here increases linearly along the radial extent of antenna elements 112a–112d, as shown in FIG. 6. Such small spacing between antenna elements 112a–112d and the ground plane near feed 120 improves the impedance match between RF feed 20 and monopole antenna 112, thereby reducing the VSWR of monopole antenna 112 and providing a corresponding increase in the gain of such monopole antenna 112. As with antennas 12, 14 (FIG. 1), monopole antenna 112 and dipole antenna 114 produce a vertically polarized beam and a horizontally polarized beam, respectively, such beams being substantially omni-directional and having substantially coincident phase centers about RF feed 120 due to the arrangement of dipole antenna elements 114a–114d about monopole antenna 112 and feed 120.

Having described preferred embodiments of the present invention, modifications and alterations thereof may become apparent to persons of ordinary skill in the art. For example, antenna system 10, and specifically monopole antenna 12 (or 112) and dipole antenna 14 (or 114) which, as discussed, are provided with substantially coincident phase centers, may alternately transmit and receive energy having circular polarization with only slight modification to system 10. For example, switch 36 may be replaced with a 90° hybrid coupler to simultaneously couple signals from transmitter 34 in quadrature to antennas 12, 14. Accordingly, it is understood that the scope of the present invention is to be limited only by the scope of the appended claims.

What is claimed is:

1. An antenna system comprising:

(a) a first antenna means for operating with radio frequency energy having a first polarization; and (b) a second antenna means for operating with radio frequency energy having a second polarization orthogonal to the first polarization, said second antenna means comprising a plurality of antenna elements disposed about said first antenna means, and wherein pairs of the plurality of antenna elements are electrically connected to form dipole antennas, and wherein the antenna elements of each said pair are disposed on opposite sides of the first antenna means.

2. The antenna system of claim 1 wherein said first antenna means comprises a plurality of antenna elements coupled to a common feed and further comprising:

a plurality of feeds correspondingly coupled to the plurality of antenna elements of the second antenna means, said plurality of feeds being disposed about said common feed.

3. The antenna system of claim 2 wherein the plurality of antenna elements of the first antenna means are alternately radially disposed about said common feed with the plurality of antenna elements of the second antenna means.

4. The antenna system of claim 3 wherein the plurality of antenna elements of the first antenna means are radially disposed about said common feed substantially orthogonally with respect to one another, and the plurality of antenna elements of the second antenna means are radially disposed about said common feed substantially orthogonally with respect to one another, with each one of the plurality of antenna elements of the first antenna means substantially bisecting the angle between a pair of the plurality of antenna elements of the second antenna means.

5. The antenna system of claim 3 further comprising:

a ground plane conductor, the common feed supporting the plurality of antenna elements of the first antenna means a first predetermined distance above the ground plane conductor, and the plurality of feeds supporting the plurality of antenna elements of the second antenna means a second predetermined distance above the ground plane conductor.

6. The antenna system of claim 5 wherein each one of the plurality of antenna elements of the first antenna means comprises a blade having a predetermined length disposed substantially vertically with respect to the ground plane conductor.

7. The antenna system of claim 5 wherein each one of the plurality of antenna elements of the second antenna means comprises a blade having a predetermined length disposed substantially horizontally with respect to the ground plane conductor.

8. The antenna system of claim 4 further comprising:
(a) means for generating a signal; and
(b) means for selectively coupling the generated signal to the first antenna means and the second antenna means in response to a control signal.

9. The antenna system of claim 8 wherein said coupling means comprises means for coupling the generated signal to the plurality of antenna elements of the second antenna means with a predetermined phase shift therebetween.

10. The antenna system of claim 9 wherein said predetermined phase shift is substantially −90°.

11. The antenna system of claim 2 further comprising:
a third antenna means for operating with radio frequency energy having a second polarization, disposed adjacent to the first and second antenna means, said third antenna means comprising a plurality of antenna elements disposed about a point.

12. The antenna system of claim 11 further comprising a ground plane conductor, the first, second and third antenna means being disposed above the ground plane conductor with the point being spaced from the common feed by a predetermined distance.

13. The antenna system of claim 12 wherein the second antenna means is selected to operate with radio frequency energy having a frequency within a first frequency range and the third antenna means is selected to operate with radio frequency energy having a frequency within a second frequency range.

14. In combination:
(a) a first antenna means for operating with radio frequency energy having a first polarization;
(b) a ground plane conductor, said first antenna means being disposed above said ground plane conductor; and
(c) a second antenna means for operating with radio frequency energy having a second polarization orthogonal to the first polarization, said second antenna means comprising a plurality of antenna elements disposed about said first antenna means above said ground plane conductor.

15. The combination of claim 14 wherein said first antenna means comprises a plurality of antenna elements coupled to a common feed and further comprising:
a plurality of feeds correspondingly coupled to the plurality of antenna elements of the second antenna means, said plurality of feeds being disposed about said common feed.

16. The combination of claim 15 wherein the plurality of antenna elements of the first antenna means are alternately radially disposed about said common feed with the plurality of antenna elements of the second antenna means.

17. The combination of claim 16 wherein the plurality of antenna elements of the first antenna means are radially disposed about said common feed substantially orthogonally with respect to one another, and the plurality of antenna elements of the second antenna means are radially disposed about said common feed substantially orthogonally with respect to one another, with each one of the plurality of antenna elements of the first antenna means substantially bisecting the angle between a pair of the plurality of antenna elements of the second antenna means.

18. The combination of claim 16 wherein the common feed supports the plurality of antenna elements of the first antenna means a first predetermined distance above the ground plane conductor, and the plurality of feeds support the plurality of antenna elements of the second antenna means a second predetermined distance above the ground plane conductor.

19. The combination of claim 18 wherein each one of the plurality of antenna elements of the first antenna means comprises a blade having a predetermined length disposed substantially vertically with respect to the ground plane conductor.

20. The combination of claim 18 wherein each one of the plurality of antenna elements of the second antenna means comprises a blade having a predetermined length disposed substantially horizontally with respect to the ground plane conductor.

21. The combination of claim 14 further comprising:
a third antenna means for operating with radio frequency energy having the second polarization, disposed adjacent to the first and second antenna means above the ground plane conductor, said third antenna means comprising a plurality of antenna elements disposed about a point spaced from the first antenna means by a predetermined distance.

22. The combination of claim 21 wherein the second antenna is selected to operate with radio frequency energy having a frequency within a first frequency range and a third antenna is selected to operate with radio frequency energy having a frequency within a second frequency range.

23. An antenna system comprising:
(a) a first antenna means for operating with radio frequency energy having a first polarization, said first antenna means comprising a first plurality of antenna elements electrically coupled to a first feed and disposed radially about said first feed;
(b) a ground plane conductor, the first feed being disposed thereon supporting the first plurality of antenna elements a predetermined distance above the ground plane conductor; and
(c) a second antenna means for operating with radio frequency energy having a second polarization orthogonal to the first polarization, said second antenna means comprising a second plurality of antenna elements each one of the second plurality of antenna elements being coupled to a corresponding one of a plurality of feeds disposed on the ground plane conductor about the first feed, with each one of the second plurality of antenna elements being radially disposed about said first feed between a pair of the first plurality of antenna elements.

24. The antenna system of claim 23 wherein said first antenna means further comprises a plurality of ground plane elements corresponding to the first plurality of antenna elements and electrically coupled to the ground plane conductor, the plurality of ground plane elements being disposed radially about the first feed below the first plurality of antenna elements and substantially aligned with said first plurality of antenna elements.

25. The antenna system of claim 24 wherein each one of the first plurality of antenna elements and the corresponding one of the plurality of ground plane elements are separated by a predetermined spacing at the first feed, said spacing increasing along the radial extent of the antenna element and the ground plane element.

26. The antenna system of claim 23 further comprising:

a third antenna means for operating with radio frequency energy having the second polarization, disposed adjacent to the first and second antenna means, said third antenna means comprising a third plurality of antenna elements disposed about a point spaced from the first feed by a predetermined distance.

27. The antenna system of claim 26 wherein the antenna system has a nominal operating wavelength, $\lambda_o$, said predetermined distance between the point and the first feed being substantially $\frac{1}{3}\lambda_o$.

28. The antenna system of claim 27 wherein the second antenna means is selected to operate with radio frequency energy having a frequency within a first frequency range and the third antenna means is selected to operate with radio frequency energy having a frequency within a second frequency range.

* * * * *